United States Patent [19]

Jobe

[11] 4,436,236

[45] Mar. 13, 1984

[54] FRONT GATE AND LATCH ASSEMBLY FOR THE GUIDE BODY OF AN INDUSTRIAL FASTENER DRIVING TOOL

[75] Inventor: William T. Jobe, Bethel, Ohio

[73] Assignee: Senco Products, Inc., Cincinnati, Ohio

[21] Appl. No.: 360,180

[22] Filed: Mar. 22, 1982

[51] Int. Cl.[3] ..... B25L 1/04

[52] U.S. Cl. ..... 227/123; 227/130

[58] Field of Search ..... 227/120, 130, 123

[56] References Cited

U.S. PATENT DOCUMENTS

| | | | |
|---|---|---|---|
| 3,273,777 | 9/1966 | Juilfs et al. | 227/123 |
| 3,905,535 | 9/1975 | Novak et al. | 227/130 X |
| 3,934,778 | 1/1976 | Males | 227/123 |
| 4,139,137 | 2/1979 | Gupta | 227/123 |

*Primary Examiner*—Paul A. Bell

*Attorney, Agent, or Firm*—Frost & Jacobs

[57] ABSTRACT

A front gate and gate latch assembly for the guide body of an industrial fastener driving tool of the type wherein the guide body and front gate, in closed position, define a drive track for the tool driver and fasteners. The gate is pivotally affixed to the guide body and is swingable between a closed position against the guide body and an open position. A latch plate having tapered end portions is slidably and captively mounted on the gate. A spaced pair of locking blocks are mounted on the guide body to either side of the gate. The latch plate is shiftable along the gate between a gate locking position wherein the latch plate ends are in wedged engagement with the locking blocks and a gate release position free of the locking blocks. The latch plate is shiftable by a manually actuable over-center locking lever assembly.

10 Claims, 8 Drawing Figures

FRONT GATE AND LATCH ASSEMBLY FOR THE GUIDE BODY OF AN INDUSTRIAL FASTENER DRIVING TOOL

TECHNICAL FIELD

The invention relates to a front gate and gate latch assembly for the guide body of an industrial fastener driving tool, and more particularly to such a front gate and front gate latch providing positive closure and easy manual opening and closing.

BACKGROUND ART

The principles of the present invention are applicable to industrial fastener driving tools of the type utilized to drive staples, nails, or other fastening means. While not intended to be so limited, the present invention will, for purposes of an exemplary showing, describe the invention in its application to an industrial staple driving tool.

In the manufacture of industrial staplers and nailers, it is common practice to provide a guide body and an associated latchable gate at the lower front nose portion of the tool. The guide body and gate (in closed position) define a drive track for the tool driver and fastener elements. The purpose of the gate is to provide access to the drive track in the event of the jamming of a fastener in the drive track.

Prior art workers have devised numerous types of gate and gate latch assemblies. Examples of such structures are taught in U.S. Pat. Nos. 3,273,777; 3,905,535; and 4,139,137.

The prior art gate and latch assemblies, of which the above mentioned patents are exemplary only, have been characterized by certain deficiencies. Force is applied to the gate latch each time a fastener is driven, because the door is a part of the drive track. This has frequently caused excessive wear of the latch mechanism. In many prior art structures, the forces required to latch and unlatch the gate are high. When the tool is jammed, as much as a 1.5 ton load may be applied to the gate. The force required to unlatch the gate frequently becomes so high, when a fastener is jammed in the drive track, that a hammer or other tool is required to unlatch the front gate.

The structure of the present invention was developed to overcome these problems and to provide a positive, easy-to-operate latch which will allow clearing of jammed fasteners with minimal effort. The structure of the present invention utilizes a three-point over-center latch mechanism attached to a moving wedge, mounted on the gate. The wedge is moved into and out of engagement with locking blocks mounted on the tool guide body. The shifting of the wedge is accomplished by operating the latch lever through an angle of about 120°.

In the structure of the present invention, the front gate is rigidly held shut during the driving of a fastener. The load bearing surfaces of the latch mechanism have been enlarged to prevent deformation and wear. The load bearing surfaces of the mating parts of the wedge and the locking blocks transmit almost all of the loads from the front gate, through the wedge into the locking blocks and thus into the guide body. The use of a wedge for this purpose provides relatively large load bearing surfaces, thus reducing the unit stress to a minimum. The wedge has a taper in the neighborhood of 16° which is a non-locking taper so that the latch can be readily opened by hand. The taper also allows for releasing the load with a minimum of sliding contact movement of the mating parts, thus reducing wear on the parts. The over-center latch mechanism incorporates an adjusting screw. This allows all parts to be manufactured using maximum tolerances. Such adjustment can be made without the use of tools.

DISCLOSURE OF THE INVENTION

According to the invention there is provided a front gate and a gate latch assembly for the guide body of an industrial fastener driving tool of the type wherein the guide body and the front gate (in closed position) define a drive track for the tool driver and fasteners. The front gate is pivotally affixed at one of its ends to the guide body. The gate is swingable between a closed position against the guide body and an open position.

A latch plate is slidably and captively mounted on the gate. The ends of the latch plate are tapered so that the latch plate can serve as a wedge element. A spaced pair of locking blocks are mounted on the guide body to either side of the gate near its free end. The latch plate or wedge element is shiftable along the gate between a gate locking position wherein the latch plate tapered ends are in wedged engagement with mating surfaces on the locking blocks, and a gate release position free of the locking blocks. The latch plate or wedge element is shiftable by a manually actuable over-center lever assembly. The lever assembly comprises an elongated element having one end pivotally attached to the latch plate or wedge element and a free end to be engaged by a finger of the operator. A link assembly is provided. One end of the link assembly is pivotally attached to the lever near its end which is pivoted to the latch plate. The other end of the link assembly is pivotally attached to the gate, near its pivoted end. The link assembly is made up of two adjustment blocks joined together by a threaded rod. In this way, the effective length of the link assembly can be adjusted to compensate for any misalignment created by the assembly of machined parts while also ensuring that the front gate is rigidly held shut by the latch assembly.

DETAILED DESCRIPTION OF THE INVENTION

Figure 1:
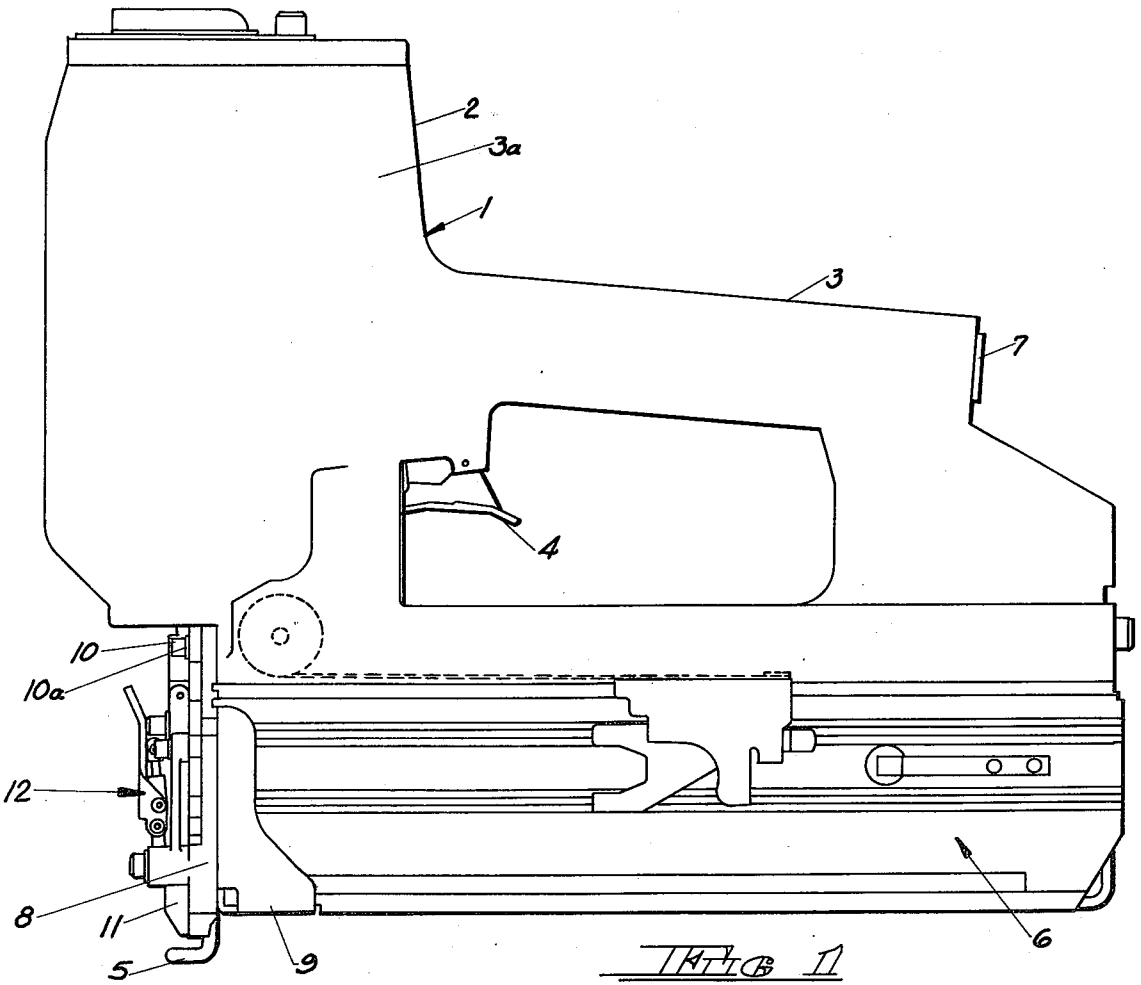
FIG. 1 is a side elevational view of an exemplary fastening tool to which the front gate and the latch assembly of the present assembly has been applied.

Turning first to FIG. 1, there is illustrated an exemplary industrial staple driving tool provided with the front gate and latch assembly of the present invention. The staple driving tool is generally indicated at 1. While the teachings of the present invention are equally applicable to electromechanically operated tools, as are well known in the art, tool 1 is illustrated as being of the pneumatic type.

Tool 1 comprises a housing 2 having a handle portion 3 and a forward portion 3*a* which houses the main valve, the cylinder, and the piston and driver assembly (not shown), all of which are well known in the art. At the juncture of housing portions 3 and 3*a* a remote valve assembly (not shown) is located within housing 3. The remote valve assembly is actuated by a trigger 4 and workpiece responsive trip 5 to actuate the main valve and cause the tool to drive a staple, again as is well known in the art. Tool 1 has a magazine portion 6 adapted to contain and advance a row of staples. Tool 1 also has a fitting 7 by which it can be connected to a source of air under pressure.

Figure 3:
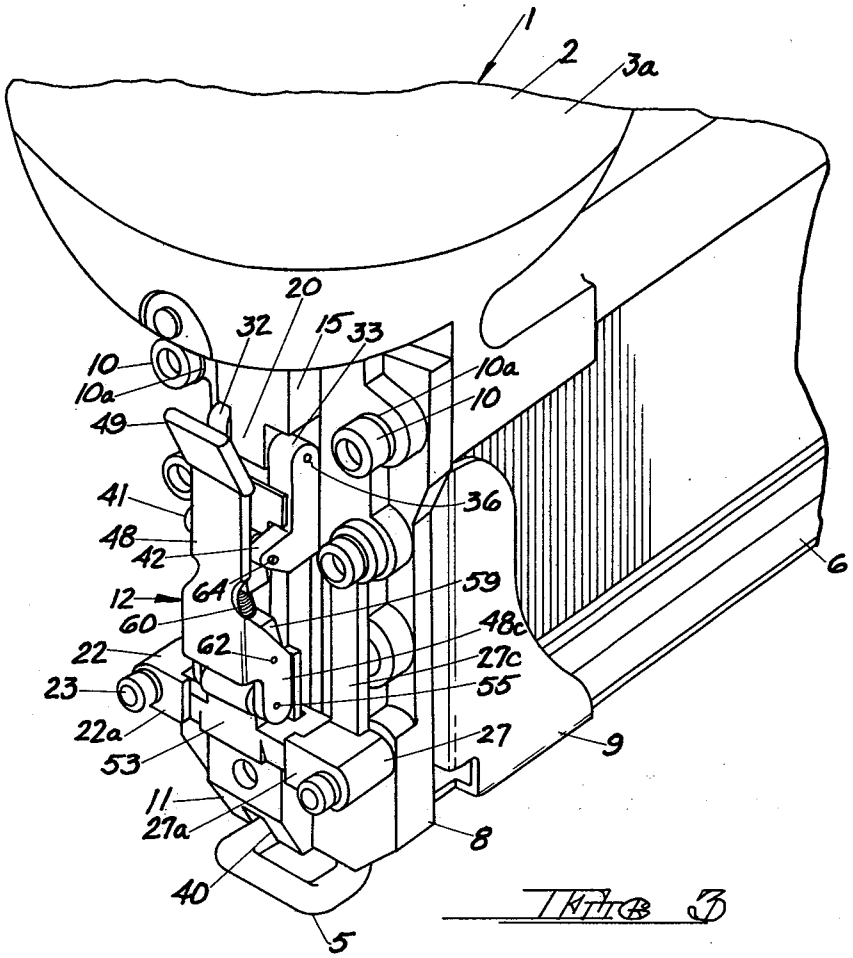
FIG. 3 is a fragmentary perspective view of the tool of FIG. 1 illustrating the guide body thereof and the front gate and latch assembly of the present invention, mounted thereon.
Figure 2:
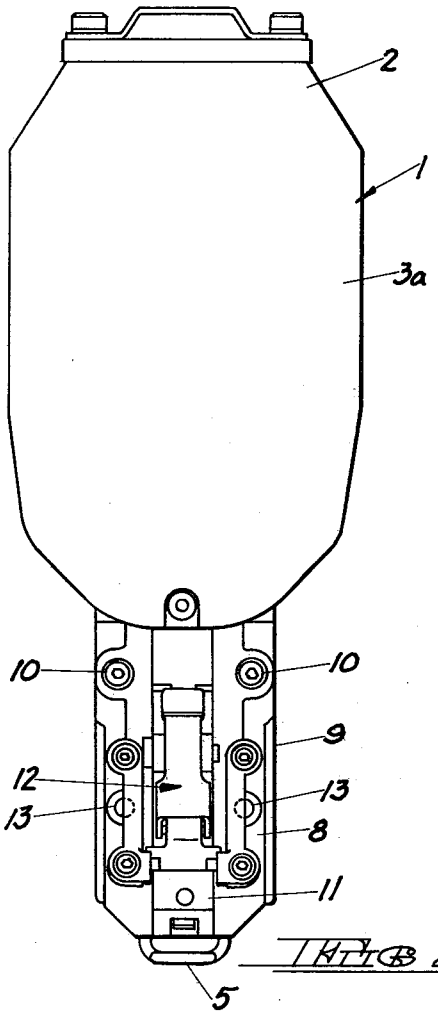
FIG. 2 is a front elevational view of the tool of FIG. 1.

At the lower forward end or nose portion of the tool, a guide body 8 is affixed to the forward end of magazine portion 6 and beneath the main cylinder containing the piston and driver assembly (not shown) located within body portion 3*a*. Guide body 8 is mounted by means of a bracket 9 and screws and lock washer sets, with one of each shown at 10 and 10*a*, respectively. Guide body 8 is provided with a forward opening, as will be described hereinafter, and a front gate 11 by which the forward opening is closed. Front gate 11, when in closed position, cooperates with guide body 8 to define a drive track for the staples and the staple driver. Guide body 8 is also provided with a rearward opening (as will be described hereinafter) communicating with magazine portion 6 so that the forwardmost staple of the row thereof within the magazine can be caused to enter the drive track, to be driven by the staple driver. Gate 11 provides access to the drive track for removal of a staple therefrom when a jam occurs. The latch means for gate 11 is generally indicated at 12 in FIGS. 1 and 2. FIG. 2 is a front view of the tool of FIG. 1. FIG. 3 is an enlarged fragmentary perspective view of the nose portion of the tool of FIG. 1. In these views, as is true of all of the Figures, like parts have been given like index numerals.

Figure 4:
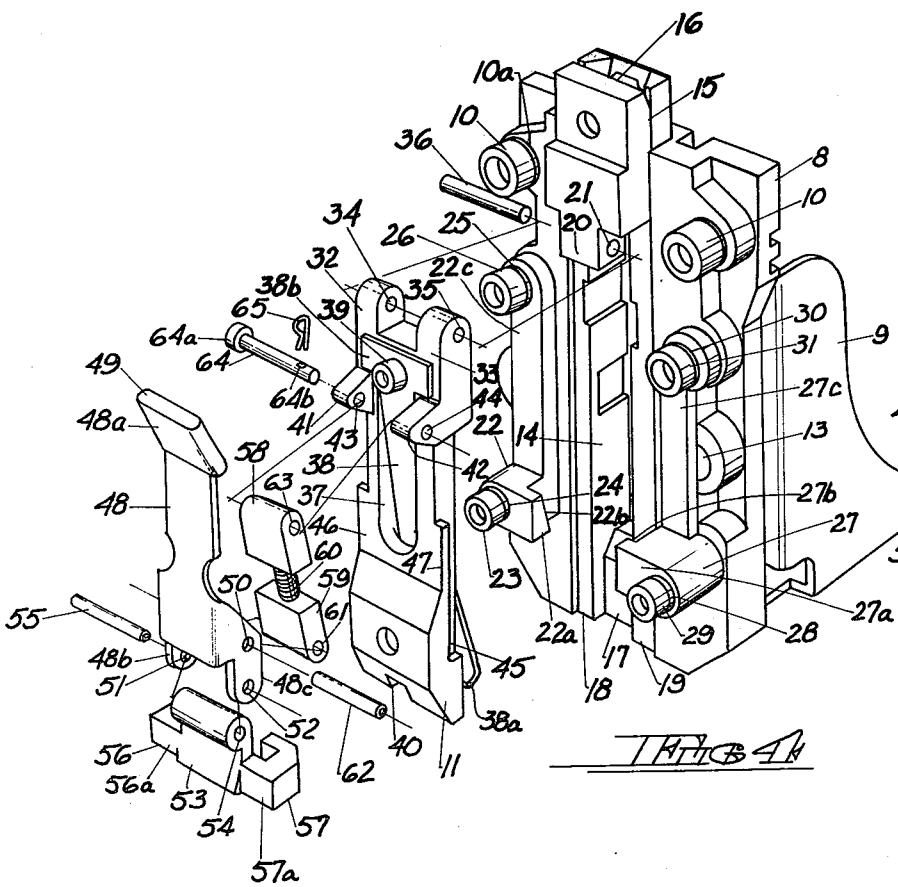
FIG. 4 is an exploded perspective view of the guide body, front gate and latch assembly.

Reference is now made to FIG. 4, constituting an exploded view of guide body 8 and front gate 11 and latch assembly 12 therefor. Guide body 8 comprises a substantially rectangular plate-like structure affixed to bracket 9 by welding, the use of threaded fastening means 13, or the like. Guide body 8 has a substantially vertical opening 14 therethrough which constitutes both the front opening closed by gate 11 and the rear opening leading to magazine portion 6. Guide body 8 has a central upper portion 15 of greater thickness than the remainder of the guide body and provided with a vertical slot 16 constituting the upper portion of the drive track through which the staple driver extends. Beneath opening 14, guide body 8 has a recessed substantially vertical surface 17 constituting the lower rearward surface of the drive track. Guide body 8 also has a pair of vertical inset surfaces 18 and 19 to either side of opening 14 and recessed surface 17. These inset surfaces 18 and 19 are adapted to be abutted by the rear surface of gate 11, when the gate is in its closed position. It will therefore readily be apparent that the rearward surface of gate 11 constitutes a continuation of the forward surface of guide track 16 when the gate 11 is in its closed position.

Upper portion 15 of guide body 8 has a downwardly depending lug 20 of narrower width than the rest of portion 15. Lug 20 has a transverse perforation 21 extending therethrough. The purpose of lug 20 and transverse perforation 21 will be apparent hereinafter.

A locking block 22 is mounted on the forward face of guide body 8 to one side of opening 14, by means of a machine screw 23 and a lock washer 24. Locking block 22 has a lateral extension 22*a*, the rear surface 22*b* of which is undercut or tapered so as to slope downwardly and rearwardly toward guide body 8. Locking block 22 has a second lateral extension 22*c* extending at right angles to extension 22*a* and along the front face of guide body 8. The free end of extension 22*c* is affixed to the front face of guide body 8 by a lock washer 25 and machine screw 26. The provision of lateral extension 22*c* and machine screw 26 ensures that locking block 22 remains properly aligned on the front face of guide body 8 and will not rotate about machine screw 23 when subjected to latching and unlatching forces.

To the opposite side of opening 14 a second locking block 27 is mounted on the face of guide body 8. Locking block 27 is a mirror image of locking block 22, but otherwise is identical thereto. Thus, locking block 27 is affixed to the forward face of guide body 8 by a lock washer 28 and a machine screw 29. It is provided with a lateral extension 27*a* having an undercut or taper on its underside as at 27*b* to provide a surface (not shown) equivalent to surface 22*b* of locking block 22 and sloping downwardly and rearwardly. Locking block 27 also has a second lateral extension 27*c*, the free end of which is affixed to the forward face of guide body 8 by lock washer 30 and a machine screw 31. This completes the structure of guide body 8.

FIG. 4 also most clearly illustrates gate 11. Gate 11 comprises an elongated member. At its upper end, gate 11 is provided with a pair of spaced lugs 32 and 33 having coaxial perforations 34 and 35 therein. Lugs 32 and 33 are spaced from each other by a distance such that lug 20 of guide body 8 can be just nicely received therebetween. A pin 36 (such as a roll pin or the like) is adapted to extend through perforations 34 and 35 in gate lugs 32 and 33 and through perforation 21 in lug 20 of guide body 8, thereby pivotally affixing gate 11 to guide body 8.

Front gate 11 is provided with a vertically oriented opening 37. Opening 37 accommodates the elongated body of a leaf spring 38. Leaf spring 38 terminates at its lower end in a hook-like configuration 38*a* located to the rear of gate 11 (see also FIG. 8). The leaf spring 38 terminates at its upper end in a T-shaped configuration 38*b* located at the front of gate 11 and affixed to the upper front surface of gate 11 by means of a machine screw 39. The purpose of leaf spring 38 will be described hereinafter. It will be noted that the lowermost edge of front gate 11 is notched as at 40 to accommodate lower end 38*a* of leaf spring 38 when it is compressed against the rear surface of front gate 11.

Near its upper end, front gate 11 has a pair of forwardly extending lugs 41 and 42. Lugs 41 and 42 have coaxial perforations 43 and 44 formed therein. The purpose of these lugs and perforations will be described hereinafter. To complete the structure of front gate 11, it will be noted from FIG. 4 that one edge of gate 11 is undercut as at 45. It will be understood that the opposite edge of gate 11 will be similarly undercut. This results in the formation of laterally extending flanges 46 and 47. The purpose of these flanges will be apparent hereinafter.

Latch assembly 12 for front gate 11 is also illustrated in the exploded view of FIG. 4. To this end, a locking lever 48 is provided. Locking lever 48 comprises an elongated member, the upper end 48*a* of which is bent upwardly and outwardly to serve as a finger engaging end. For the comfort of the operator, upper end 48*a* may be provided with a rubber or plastic cover 49, as shown in the drawings.

At its lower end, locking lever 48 is provided with a pair of rearwardly extending flanges 48*b* and 48*c*. Flanges 48*b* and 48*c* are provided with a first pair of coaxial perforations, only one of which is visible in FIG. 4 at 50. Flanges 48*b* and 48*c* are also provided with a second pair of coaxial perforations 51 and 52 at their lowermost ends.

A latch plate or wedge is illustrated at 53. The upper end of latch plate 53 is provided with a transverse perforation 54 and is so sized as to be just nicely received between flanges 48*b* and 48*c* of locking lever 48. The upper portion of latch plate 53 is pivotally attached to locking lever flanges 48*b* and 48*c* by means of pivot pin 55 passing through flange perforations 51 and 52 and latch plate perforation 54. Latch plate 53 has, to either of its sides, extensions 56 and 57 which are of U-shaped configuration. This enables latch plate 53 to have a sliding engagement with front gate 11, with extensions 56 and 57 engaging the front gate side flanges 46 and 47, respectively. It will be noted that extensions 56 and 57 of latch plate 53 have sloping surfaces 56*a* and 57*a*, respectively. These surfaces slope downwardly and inwardly and substantially correspond in angle to the sloping locking block surfaces 22*b* and 27*b*, respectively. The purpose for this will be described hereinafter.

To complete latch assembly 12, a pair of identical adjustment blocks 58 and 59 are provided, joined together by a threaded adjustment screw 60. Adjustment block 59 has a transverse perforation 61 therethrough. Adjustment block 59 is of such size as to be just nicely received between locking lever flanges 48*b* and 48*c*. Adjustment block perforation 61 can be aligned with the upper perforations in flanges 48*b* and 48*c* (one of which is shown at 50) so that a pin 62 can be inserted therethrough to pivotally mount adjustment block 59 to locking lever flanges 48*b* and 48*c*.

Upper adjustment block 58 has a transverse perforation 63 extending therethrough. Block 58 is so dimensioned as to be just nicely received between lugs 41 and 42 of gate 11. Adjusting block 58 is pivotally affixed to lugs 41 and 42 by means of a pin 64 passing through lug perforations 43 and 44 and adjustment block perforation 63.

All of pins 36, 55, 62 and 64 may be of any appropriate type such as roll pins or the like. Pin 64, however, may alternatively be a solid pin provided with a head 64*a* at one end and a transverse perforation 64*b* at the other. Transverse perforation 64*b* is intended to receive a manually removable fastener such as a small cotter pin 65 or the like, to maintain pin 64 in place. The purpose of this is to render pin 64 readily removable without the use of tools so that the latch mechanism can be manually adjusted, as will be described hereinafter.

Figure 5:
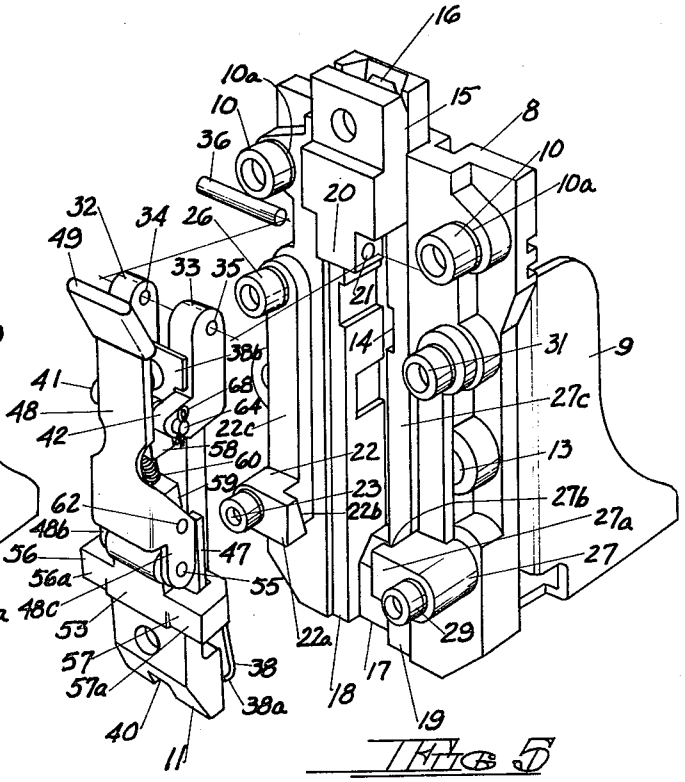
FIG. 5 is an exploded perspective view, similar to FIG. 4, but with the over-center latch assembly having been mounted on the gate.

Reference is now made to FIG. 5 which is an exploded view similar to FIG. 4. FIG. 5 differs from FIG. 4, however, in that the elements making up latch assembly 12 have been mounted on front gate 11. To this end, latch plate 53 has been slid into place on front gate 11 with its U-shaped extensions 56 and 57 engaging flanges 46 and 47 of front gate 11. Latch plate 53 is pivoted to the locking lever flanges 48*b* and 48*c* by pin 55. Similarly, adjustment block 59 is pivoted to these flanges by pin 62. Upper adjustment block 58 is, in its turn, pivotally affixed to front gate lugs 41 and 42 by pin 64. To complete the structure of FIG. 5, it is only necessary to attach front gate 11 to guide body lug 20 by means of pivot pin 36. The completed structure is shown in its closed and latched condition in FIG. 3.

Figure 6:
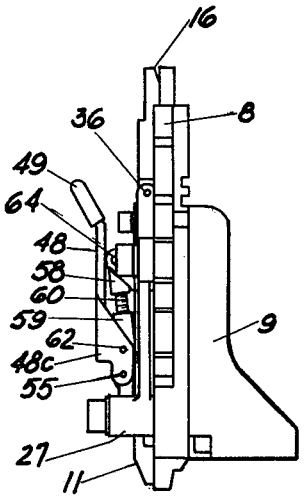
FIG. 6 is a side elevational view of the guide body, front gate and latch assembly of the present invention, illustrating the front gate and latch assembly in their closed positions.

The invention having been described in detail, its operation can be set forth as follows. Reference is made first to FIGS. 3 and 6. When front gate 11 is in its closed and latched position, locking lever 48 has pivoted about pivot pin 62 to a position substantially parallel to gate 11 and the front face of guide body 8. By virtue of the configuration of locking lever flanges 48*b* and 48*c*, this means that pivot pin 55 is in its lowermost position as viewed in FIGS. 3 and 6. This, in turn, means that latch plate or wedge 53 is also in its lowermost position with its sloped surfaces 56*a* and 57*a* engaged beneath the undercut sloped surfaces 22*b* of locking block 22 and 27*b* of locking block 27, respectively. Cooperating surfaces 22*b* and 56*a* and cooperating surfaces 27*b* and 57*a* slope rearwardly and downwardly at an angle of approximately 16° to the vertical (as viewed in FIGS. 3 and 6) so that the wedging action therebetween is of the non-locking type. The slope or taper on these surfaces is not limited to 16°, but must be a non-locking taper so that the gate can indeed be opened. Cooperating surfaces 22*b*–56*a* and 27*b*–57*a* are relatively large load bearing surfaces, thereby reducing the unit stress to a minimum. In the event of a jam, these load bearing surfaces transmit almost all of the load from front gate 11, through latch plate 53 to locking block 22 and 27, and thence into guide body 8.

It will be noted that locking lever 48, as viewed in FIGS. 3 and 6, is in an over-center locked position. Thus it will be noted from FIG. 6 that pivot pin 62 is located to the right of an imaginary line drawn through pivot pins 64 and 55. Since locking lever 48 achieves this over-center position, forces tending to open front gate 11 tend to urge locking lever 48 even further toward its locked position. This, in turn, tends to amplify the wedged condition of locking block and latch plate surfaces 22*b*–56*a* and 27*b*–57*a*.

The primary purpose of leaf spring 38 is to extend across drive track 16 when front gate 11 is in its closed position. Thus, when front gate 11 is in its closed position, leaf spring 38 extends through gate 11 and its hook-shaped lower end 38*a* abuts surface 17 of guide body 8. With spring 38 spanning the drive track from front to rear, the legs of a staple being driven into a workpiece will lie to either side of spring 38. When a staple first contacts the workpiece, the legs thereof have a tendency to splay away from each other or to buckle toward each other. The lateral sides of the drive track will prevent the legs from splaying away from each other, while the presence of spring 38 will keep the staple legs from buckling toward each other, with the result that the legs will be driven into the workpiece at substantially 90° to the workpiece surface. During final seating of the staple, the staple crown and the lowermost end of the staple driver will pass between lower end 38*a* of spring 38 and guide body surface 17, causing spring 38 to move toward the rear surface of front gate 11 and out of the way, with notch 40 in the lower edge of front gate 11 accommodating hooked end 38*a* of spring 38.

To unlatch front gate 11, it is only necessary to engage upper covered end 49 of locking lever 48 with a finger and to apply a pulling force to upper end 49 of locking lever 48 in a direction away from front gate 11. The force required is that necessary to cause pivot pin 62 to shift in front of the imaginary line drawn between pivot pins 64 and 65, bringing pivot pin 62 from its over-center latched position to its over-center unlatched position. Pivoting of locking lever 48 about pivot pin 62 will cause the pivoted connection of locking lever 48 and latch plate 53 (i.e. pivot pin 55) to shift upwardly. This, in turn, will cause latch plate wedging surfaces 56*a* and 57*a* to move out of engagement with locking block wedging surfaces 22*b* and 27*b*. At this point, leaf spring 38 will cause front gate 11 to shift open slightly. The relative position of the parts at this stage is illustrated in FIG. 7.

Figure 7:
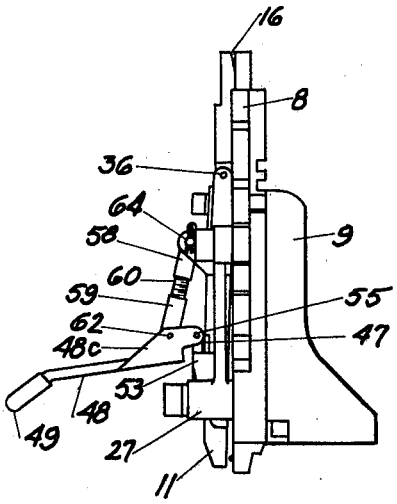
FIG. 7 is a side elevational view of the guide body, front gate and latch assembly of the present invention, illustrating the latch assembly in its unlatched position.
Figure 8:
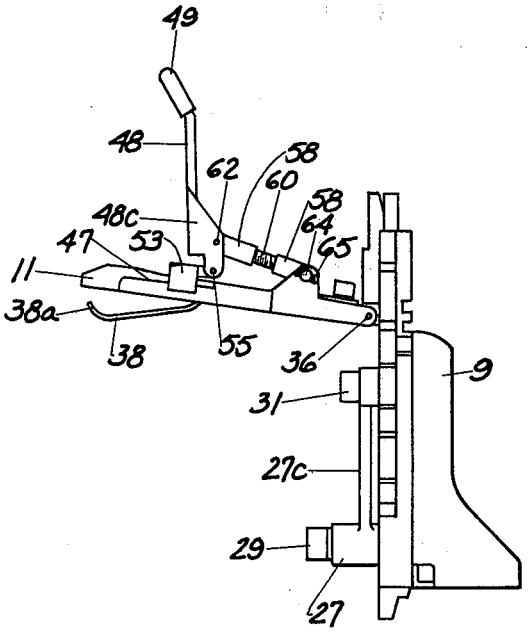
FIG. 8 is a side elevational view of the guide body, front gate and latch assembly, illustrating the front gate in its open position.

Once released, as shown in FIG. 7, front gate 11 and latch assembly 12 can be pivoted upwardly as shown in FIG. 8, giving free access to the drive track to remove any staple therefrom which might have become jammed therein.

To relatch front gate 11, the above procedure is essentially repeated in reverse order. First of all, front gate 11 and latch assembly 12 are shifted from the open position shown in FIG. 8 to the partially closed position shown in FIG. 7. It is then only necessary to pivot locking lever 48 upwardly and rearwardly from the position shown in FIG. 7 to the position shown in FIG. 6, about pivot pin 62. As a result of this pivoting movement of locking lever 48, pivot pin 55 and thus latch plate 53 will shift downwardly as viewed in the Figures. Cooperating surfaces 22*b*–56*a* and 27*b*–57*a* on locking blocks 22 and 27 and latch plate 53 will engage each other and come into full wedged engagement as pivot pin 62 snaps to its over-center locked position shown in FIG. 6. In this fashion, a positive and easy-to-latch system is provided.

As indicated above, headed pivot pin 64 can readily be manually removed without the necessity of tools, simply by removing small cotter pin 65. This will free one end of the link assembly comprising adjustment blocks 58 and 59 and threaded screw 60. By turning adjustment block 58, the effective length of this assembly can be changed. Thus, the over-center latch assembly is capable of quick and easy adjustment. This permits all of the parts to be manufactured using maximum tolerances.

It will be understood by one skilled in the art that, in use, tool 1 can assume any orientation. Therefore, terms such as "upper", "lower", "vertical", "horizontal" and the like, used herein and in the claims, are used in association with the accompanying Figures solely for purposes of clarity of description.

Modifications may be made in the invention without departing from the spirit of it.

What is claimed is:

1. A fastener driving tool of the type having a fastener-containing magazine, a reciprocating fastener driver, a guide body communicating with said magazine and having a front opening, and an elongated front gate closing said front opening, said gate being pivotally affixed at one end to said guide body and being swingable between open and closed positions, said gate in closed position and said guide body defining a drive track for said fasteners and said fastener driver, characterized by a latch plate extending transversely of the long axis of said gate and being captively and slidably mounted on said gate, said latch plate having end portions extending laterally to either side of said gate, a spaced pair of locking blocks mounted on said guide body to either side of said front opening, said locking blocks having opposed laterally extending lugs, said latch plate being shiftable along said gate between a gate-locking position near the free end of said gate wherein said latch plate ends are in wedging engagement with said locking block lugs and a gate release position free of said locking block lugs, and a manually actuable over-center lever assembly to shift said latch plate.

2. The structure claimed in claim 1 wherein said latch plate ends have tapered surfaces thereon, said locking block lugs having correspondingly tapered surfaces, said surfaces cooperating to provide said wedged engagement between said locking block lugs and said latch plate ends, the angularity of said tapered surfaces being such that they constitute non-locking, releasing tapers.

3. The structure claimed in claim 1 including longitudinally extending flanges on either side of said gate, said latch plate ends being so configured as to slidingly engage said flanges.

4. The structure claimed in claim 1 wherein said latch assembly comprises a locking lever and a link element, said locking lever comprising an elongated element having a first end pivotally attached to said latch plate, said locking lever having a second end configured for manual engagement, said link having a first end pivotally attached to said gate near that end of said gate pivoted to said guide body, said link having a second end pivotally attached to said lever near said first end thereof, said locking lever being pivotable about said pivotal attachment of said locking lever and said second link end between a gate-unlatched position wherein said latch plate is free of said locking blocks and a gate-latched position wherein said latch plate is in wedged engagement with said locking blocks, said locking lever being substantially parallel to said gate and said guide body when in said gate-latched position with said pivotal attachment of said locking lever and said second link end being over-center with respect to said pivotal attachment of said first link end and said gate and said pivotal attachment of said first locking lever end and said latch plate.

5. The structure claimed in claim 2 including longitudinally extending flanges on either side of said gate, said latch plate ends being so configured as to slidingly engage said flanges.

6. The structure claimed in claim 4 wherein said link is adjustable in length.

7. The structure claimed in claim 4 wherein said link comprises first and second adjustment bodies joined together by a threaded member having a first end threadedly engaged in said first adjustment body and a second end threadedly engaged in said second adjustment body, said first adjustment body terminating in said first link end and said second adjustment body terminating in said second link end, said pivotal attachment of said first link end to said gate being manually detachable whereby said first adjustment body can be rotated with respect to second adjustment body to change the effective length of said link.

8. The structure claimed in claim 5 wherein said latch assembly comprises a locking lever and a link element, said locking lever comprising an elongated element having a first end pivotally attached to said latch plate, said locking lever having a second end configured for manual engagement, said link having a first end pivotally attached to said gate near that end of said gate pivoted to said guide body, said link having a second end pivotally attached to said lever near said first end thereof, said locking lever being pivotable about said pivotal attachment of said locking lever and said second link end between a gate-unlatched position wherein said latch plate is free of said locking blocks and a gate-latched position wherein said latch plate is in wedged engagement with said locking blocks, said locking lever being substantially parallel to said gate and said guide body when in said gate-latched position with said pivotal attachment of said locking lever and said second link end being over-center with respect to said pivotal attachment of said first link end and said gate and said pivotal attachment of said first locking lever end and said latch plate.

9. The structure claimed in claim 8 wherein said link is adjustable in length.

10. The structure claimed in claim 8 wherein said link comprises first and second adjustment bodies joined together by a threaded member having a first end threadedly engaged in said first adjustment body and a second end threadedly engaged in said second adjustment body, said first adjustment body terminating in said first link end and said second adjustment body terminating in said second link end, said pivotal attachment of said first link end to said gate being manually detachable whereby said first adjustment body can be rotated with respect to second adjustment body to change the effective length of said link.

* * * * *